US006367713B1

(12) United States Patent
Robinson et al.

(10) Patent No.: US 6,367,713 B1
(45) Date of Patent: Apr. 9, 2002

(54) HIGH DEFINITION RAIN CURTAIN

(75) Inventors: Alan Robinson, El Monte; William Knapp, Carmel Valley, both of CA (US)

(73) Assignee: WET Enterprises, Inc., Universal City, CA (US)

( * ) Notice: Subject to any disclaimer, the term of this patent is extended or adjusted under 35 U.S.C. 154(b) by 0 days.

(21) Appl. No.: 08/799,252

(22) Filed: Feb. 14, 1997

Related U.S. Application Data

(63) Continuation-in-part of application No. 08/632,292, filed on Apr. 15, 1996, now abandoned, which is a continuation of application No. 08/285,190, filed on Aug. 2, 1994, now abandoned.

(51) Int. Cl.[7] ..... B05B 17/08; B05B 1/16
(52) U.S. Cl. ..... 239/170; 239/22
(58) Field of Search ..... 239/20, 21, 22, 239/99, 17, 12, 170; 137/624.14, 624.18

(56) References Cited

U.S. PATENT DOCUMENTS

| | | | | | |
|---|---|---|---|---|---|
| 1,676,943 | A | | 7/1928 | Dargavel | |
| 1,780,687 | A | | 11/1930 | Smith | |
| 3,749,311 | A | * | 7/1973 | Hruby, Jr. | 239/17 |
| 3,827,481 | A | | 8/1974 | Mandy et al. | |
| 4,204,631 | A | * | 5/1980 | Hruby, Jr. | 239/17 |
| 4,248,266 | A | * | 2/1981 | Queen | 137/606 |
| 4,405,084 | A | | 9/1983 | Georgiev et al. | |
| 4,921,002 | A | * | 5/1990 | Christon et al. | 137/624.18 |
| 5,201,342 | A | * | 4/1993 | Rosenberg | 137/624.14 |
| 5,249,745 | A | | 10/1993 | Bertolotti | |
| 5,820,022 | A | * | 10/1998 | Fukano et al. | 239/17 |

FOREIGN PATENT DOCUMENTS

| | | |
|---|---|---|
| CH | 234328 | 1/1945 |
| DE | 75769 | 6/1894 |

* cited by examiner

*Primary Examiner*—David A. Scherbel
*Assistant Examiner*—Davis Hwu
(74) *Attorney, Agent, or Firm*—Blakely, Sokoloff, Taylor & Zafman LLP

(57) ABSTRACT

A water display which contains a plurality of drip tubes that are suspended from a structure, and periodically drip droplets of fluid in a manner that simulates "rain fall". The tubes are attached to a tank that contains a ballast and a volume of fluid. When the water display is off, the ballast is located in an upper position so that the level of fluid is below the openings of the tubes. The display further contains a control mechanism that lowers the ballast into the fluid. Lowering the ballast, displaces the fluid to a level above the opening of the tubes, wherein the fluid flows out of the tank and through the tubes. The control mechanism then raises the ballast to the first position to again lower the fluid to a level below the opening of the tube. The cycle of lowering and raising the ballast is repeated in a periodic manner.

15 Claims, 4 Drawing Sheets

HIGH DEFINITION RAIN CURTAIN

This application is a continuation-in-part of application No. 08/632,292, filed on Apr. 15, 1996, now abandoned, which is a continuation of application Ser. No. 08/285,190, filed on Aug. 2, 1994, now abandoned.

BACKGROUND OF THE INVENTION

1. Field of the Invention

The present invention relates to a water display that creates a curtain of rain.

2. Description of Related Art

Large public buildings typically have a chandelier or other ornamental device to compliment the appearance of the structure. Water displays such as water fountains and the like, are particularly attractive because of the soothing sound of running water and the addition of a natural element in an otherwise man made surrounding. A typical water fountain will have a stream, or streams, of water that flow from an orifice and fall into a pool. The novelty of conventional water falls and water displays are such that these items no longer provide a source of amusement. It would therefore be desirable to provide a water display that can amuse an audience. It would also be desirable to have an amusing water display which creates a flow of water that simulates rain fall. The unique water flow pattern of such a display would capture the attention of the viewers and provide the soothing sound of rain.

SUMMARY OF THE INVENTION

The present invention is a water display which contains a plurality of drip tubes that are suspended from a structure, and periodically drip droplets of fluid in a manner that simulates "rain fall". The tubes are attached to a tank that contains a ballast and a volume of fluid. When the water display is off, the ballast is located in an upper position so that the level of fluid is below the openings of the tubes. The display further contains a control mechanism that lowers the ballast into the fluid. Lowering the ballast, displaces the fluid to a level above the openings of all the tubes simultaneously, wherein the fluid flows out of the tank and through the tubes. The control mechanism then raises the ballast to the first position to again lower the fluid to a level below the openings of all the tubes. The cycle of lowering and raising the ballast is repeated in a periodic manner.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
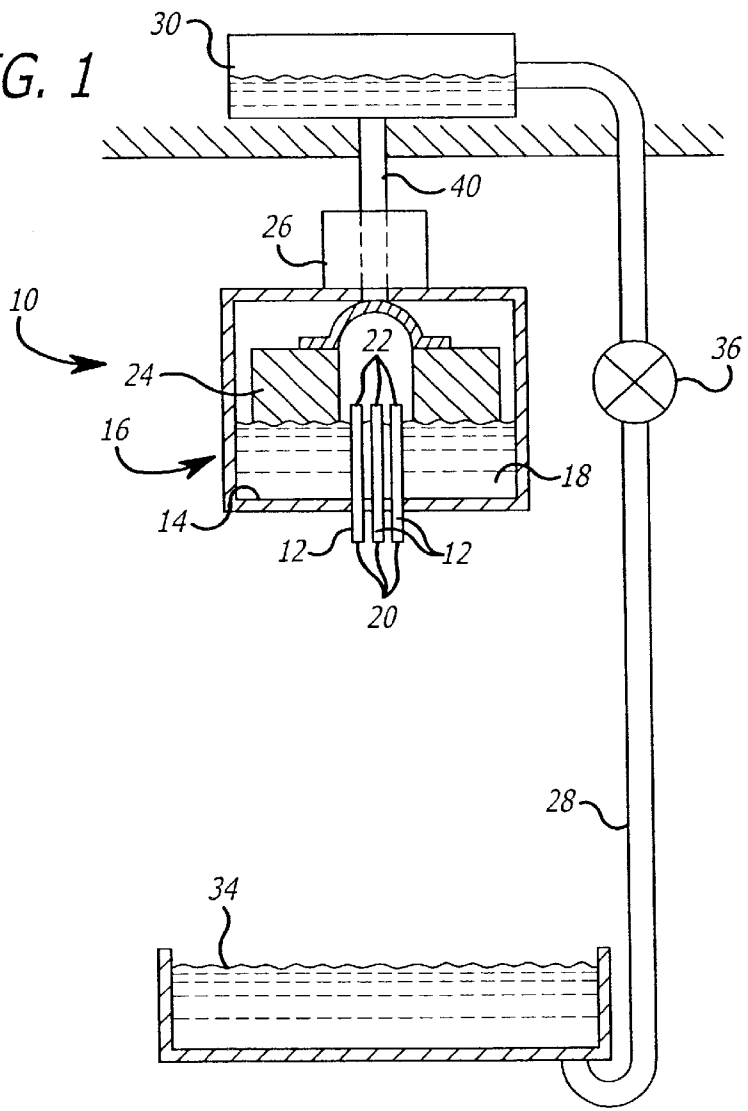
FIG. 1 is a cross-sectional view of a water display of the present invention in an "off" position.

Referring to the drawings more particularly by reference numbers, FIG. 1 shows a water display 10 of the present invention. The water display 10 is typically suspended from a structure such as the ceiling or roof of a building. For example, the display may be installed into the open area of an airport or a shopping mall. The water display 10 creates a flow of fluid that simulates "rain fall". The simulated rain fall can improve both the acoustic and visual appearance of the structure. Additionally, the rain producing display can create a source of amusement for the occupants of the building.

The water display 10 includes a plurality of tubes 12 attached to the floor 14 of a tank 16. The tank 16 contains a volume of fluid 18. The fluid 18 is typically water although other liquids can be used. The tubes 12 each have an outlet 20 and an inlet opening 22. The inlet openings 22 are located a predetermined distance from the floor 14 of the tank 16. Each tube 12 has an inner diameter small enough to create droplets of fluid from the outlets 20 when fluid flows into the inlet openings 22.

Figure 2:
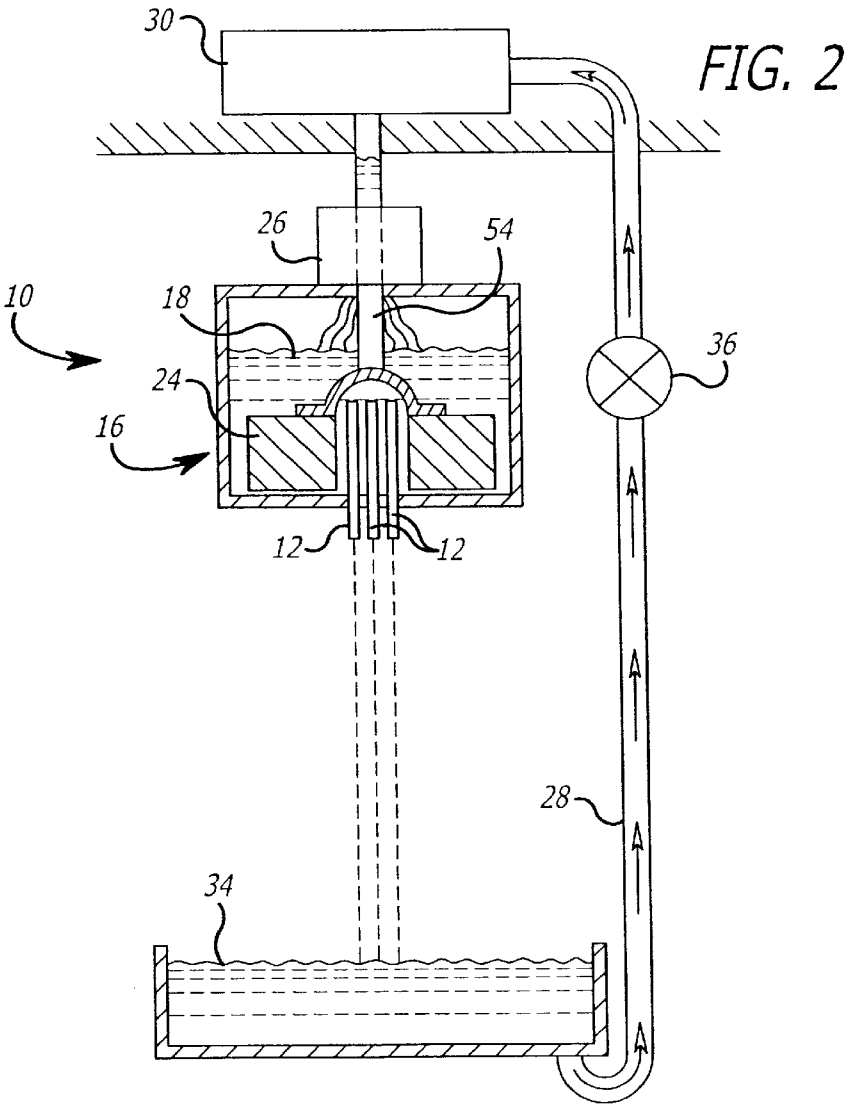
FIG. 2 is a cross-sectional view of the water display in an "on" position.

Located within the tank 16 is a ballast 24. The ballast 24 is connected to a control mechanism 26 that can move the ballast 24 between a first position shown in FIG. 1, and a second position shown in FIG. 2. When the ballast 24 is in the first position, the level of the fluid 18 is below the inlet openings 22 of the tubes 12, so that fluid does not flow out of the display 10. When the ballast 24 is moved to the second position, the volume of the ballast 24 displaces an equal volume of fluid. The fluid is displaced to a level above the inlet openings 22, wherein the fluid flows out of the tank 16 and through the tubes 12.

The tank 16 is coupled to a supply pipe 28 and a reservoir 30. The supply pipe 28 is connected to a pool 34 and a pump 36. The pool 34 captures the fluid that flows from the tubes 12 of the display. The pump 36 pumps the fluid from the pool 34 to the reservoir 30. Fluid is provided to the tank 16 from the supply pipe 28 and reservoir 30 when the ballast 24 is in the second position. The fluid flows into the tank 16 at a rate that is approximately equal to the flowrate of the fluid flowing through the tubes 12, so that the tank 16 is replenished with fluid when the display is generating the simulated rain fall.

FIGS. 3 and 4A–C shows a preferred embodiment of the control mechanism 26. The mechanism 26 includes an outer pipe 40 which has an inner channel that is fluid communication with the reservoir 30. An inner sleeve 42 is attached to the outer pipe 40. The inner sleeve 42 includes a plurality of side openings 46 that are in fluid communication with the reservoir 30 through the outer pipe 40. The inner sleeve 42 also has a top opening 48 that receives a pilot pin 50.

Figure 4A:
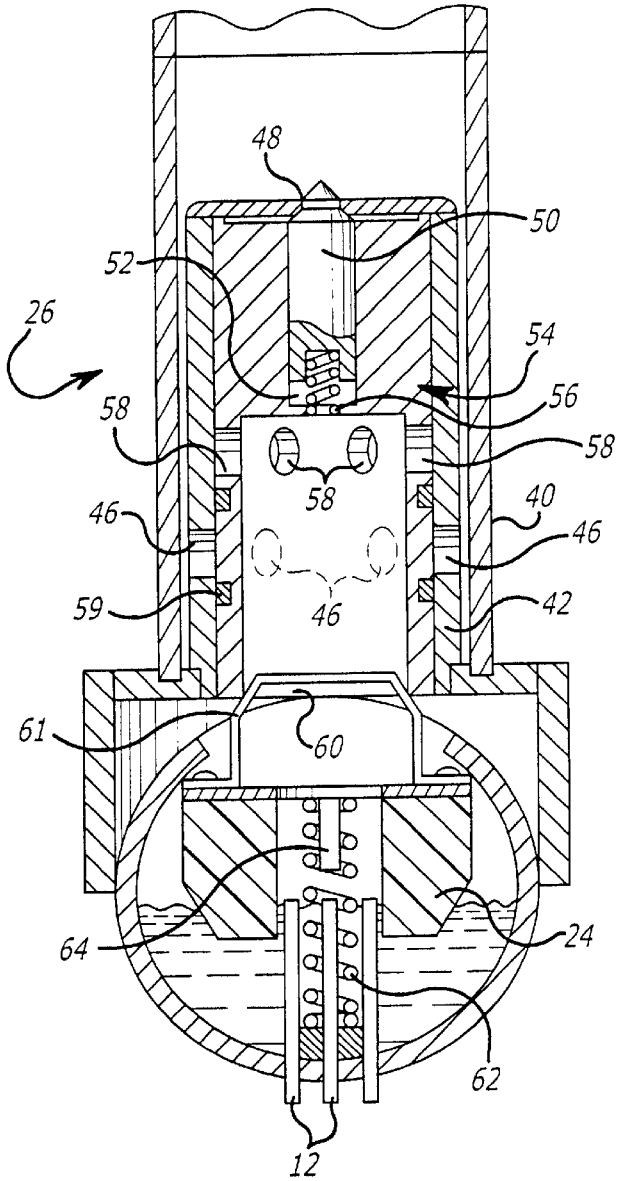
FIGS. 4A–B are cross-sectional views showing the control valve moving into an open position.
Figure 4B:
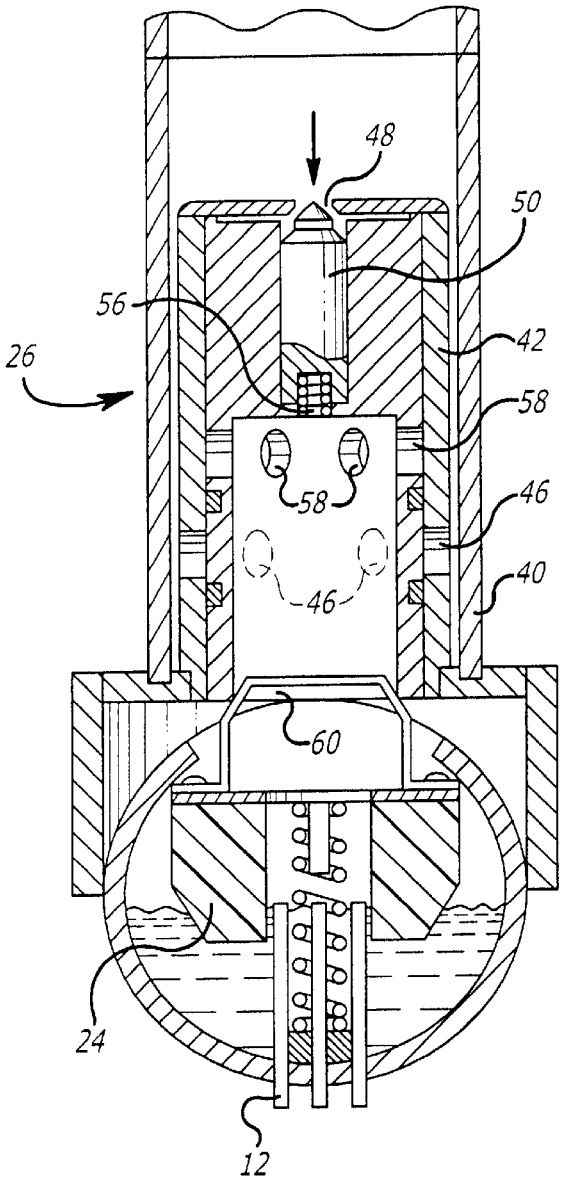
Figure 4C:
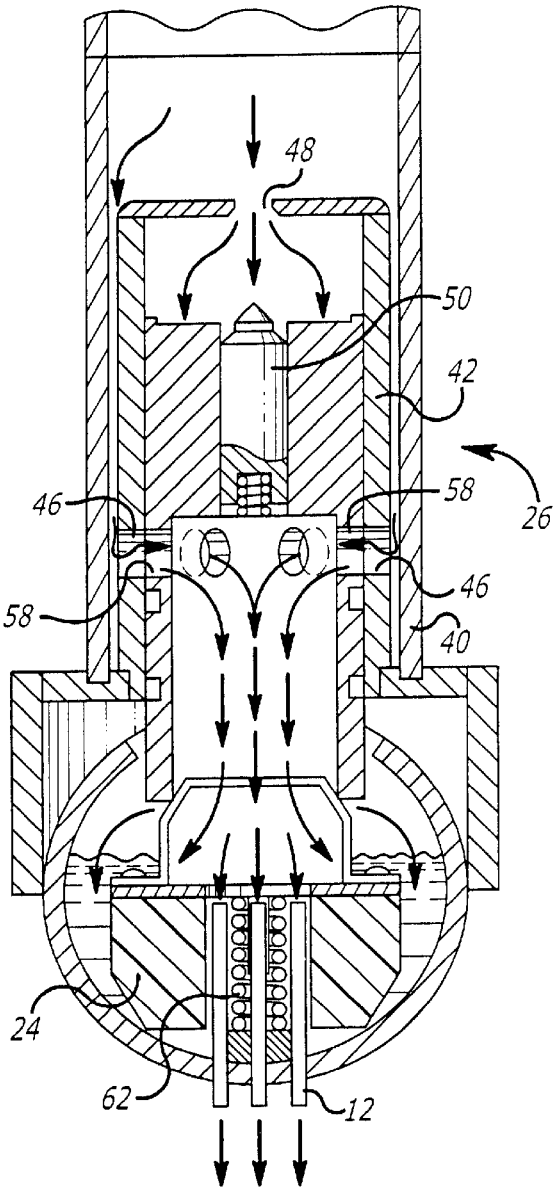

The pilot pin 50 is located within a cavity 52 of a poppet valve 54. The pilot pin 50 is biased into the top opening 48 of the inner sleeve 42 by a spring 56 located within the cavity 52. The poppet valve 54 can move relatively to the inner sleeve 42 and the pin 50 can move relative to the valve 54. The valve 54 has a number of openings 58 located above a pair of O-rings 59 and a bottom opening 60 that is in fluid communication with the tank 16. The openings 46 are between the O-rings 59 so that fluid cannot flow there through when the valve 54 is in a closed position, as shown in FIGS. 4A–B. When the valve 54 is in an open position, as shown in FIG. 4C, the valve openings 58 are aligned with the inner sleeve openings 46 so that fluid can flow from the receiver 30 into the tank 16. In the closed position openings 46 and 58 are not aligned so that fluid cannot flow into the tank 16.

Figure 3:
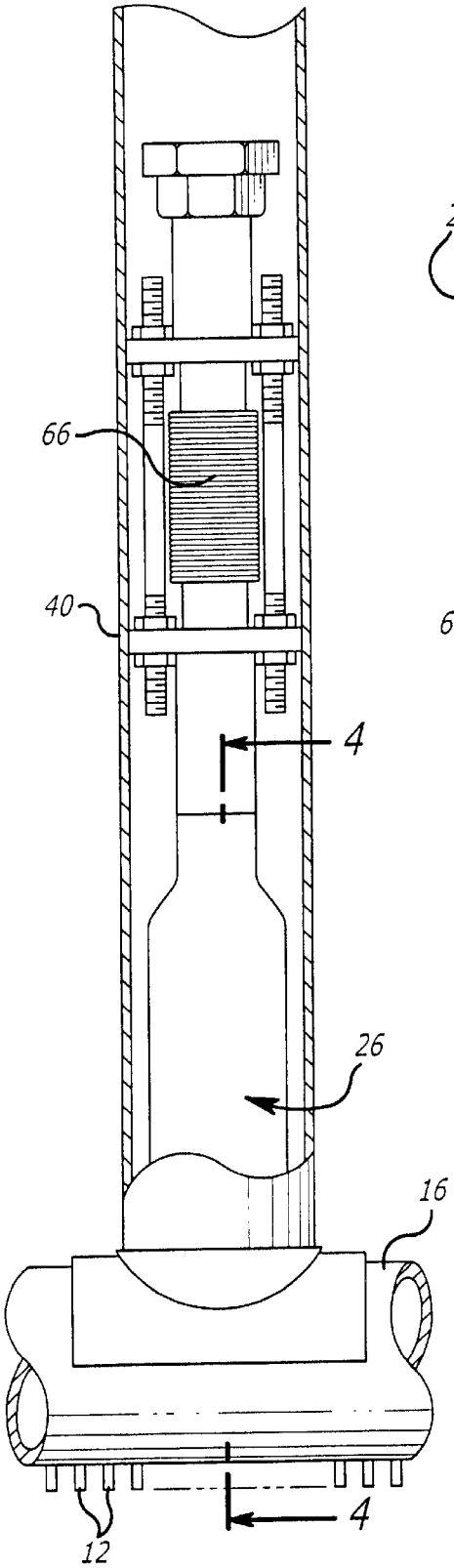
FIG. 3 is a side sectional view showing a control valve of the water display.

As shown in FIG. 4A, the poppet valve 54 is coupled to the ballast 24 by a bracket 61 which allows fluid to flow through the opening 60 and into the tank 16. The ballast 24 is biased into an upward position by a spring 62 that is captured by a pin 64. As shown in FIG. 3, the mechanism 26 may also have a balloon valve 66 that can be inflated to prevent the flow of fluid through the outer pipe 40.

In operation, as shown in FIG. 4B, fluid flows into the reservoir 30 and the outer pipe 40 until the hydrostatic pressure on the pilot pin 50 exceeds the force of the spring 56, wherein the pin 50 moves in a downward direction. The hydrostatic fluid pressure is then exerted on the top surface of the poppet valve 54. The poppet valve 54 has a larger area than the pilot pin 50 so that a greater force is exerted onto the valve 54, the ballast 24 and the spring 62. As shown in FIG. 4C, the hydrostatic force exceeds the force of the ballast spring 62, the poppet valve 54 moves into the open position and the ballast 24 moves down into the tank 16.

Figure 5:
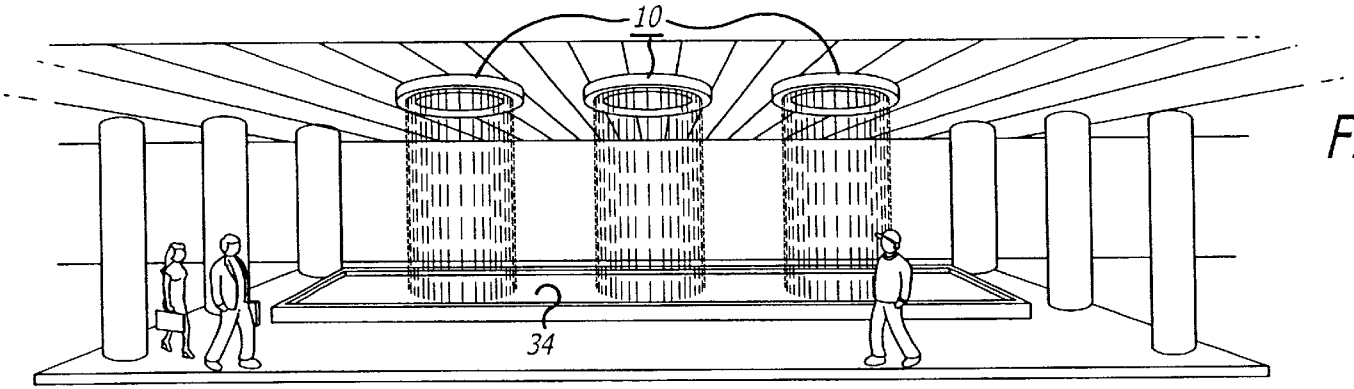
FIG. 5 is a perspective view of the water display creating a curtain of rain.

Movement of the ballast 24 into the tank 16 increases the tank fluid level so that fluid flows the tubes 12. The small diameter of the tubes 12 constricts the flow of fluid therein and creates droplets that fall into the pool 34. As shown in FIG. 5, the combination of tubes creates a large number of droplets that simulate a curtain of rain. The openings 46 and 58 are aligned so that fluid can flow through the pipe 40 and into the tank 16. The flow of fluid from the reservoir 30 is much greater than the flow of fluid into the reservoir 30.

The unequal fluid flow rapidly reduces the fluid level within the reservoir 30 and the hydrostatic pressure on the ballast 24 and pilot pin 50, so that the hydrostatic forces fall below the force of springs 56 and 62.

The spring 62 moves the ballast 24 back out of the fluid within the tank 16 and the poppet valve 54 back to the closed position, thereby terminating flow into and out of the tank 16. The spring 56 also moves the pilot pin 50 back into the top opening 48. The pump 36 fills the reservoir 30 until the hydrostatic pressure exceeds the spring 56 force wherein the process is repeated.

Figure 6:
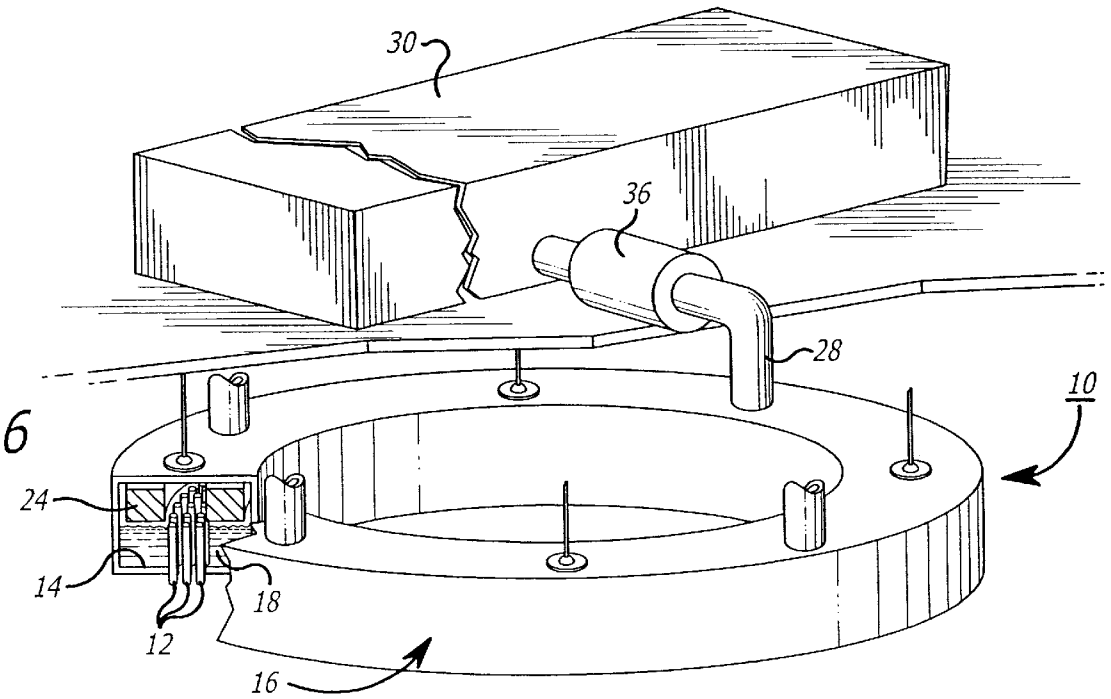
FIG. 6 is a perspective view of the water display mounted to a ceiling.

As shown in FIG. 6, the tank 16 can be shaped as an annulus with a diameter of approximately 6 feet. There are preferably 4 separate supply pipes 28 that are approximately 20 feet long and 1 inches in diameter. The display 10 typically contains thousands of tubes 12 that each have a 1/16 inch inner diameter and are separated from each other by a 1/4 inch space. The tubes 12 are preferably arranged within three rows so that the display creates a curtain of water. The ballast 24 is approximately the same diameter as the tank 16 and moves 1/2–1 inches between the raised and lowered positions.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A water display, comprising:

a tank that has a floor and contains a fluid;

a tube attached to said tank, said tube having an opening located a predetermined distance from said floor;

a ballast located within said tank; and, movement means for moving said ballast between a first position where the level of fluid is below said opening of said tube and a second position where said ballast displaces the fluid to a level above said opening of said tube, wherein the fluid flows out of said tank and through said tube.

2. The water display as recited in claim 1, wherein said tube creates a plurality of fluid droplets.

3. The water display as recited in claim 1, further comprising supply means for introducing fluid into said tank when said ballast is in said second position at a flowrate approximately equal to a flowrate of fluid through said tube.

4. The water display as recited in claim 3, wherein said supply means includes a supply pipe coupled to said tank and said movement means includes a pressure sensitive piston that is coupled to said supply pipe, said pressure sensitive piston moves said ballast to said second position when a fluid pressure within said supply pipe reaches a threshold level.

5. The water display as recited in claim 4, said supply pipe is filled with fluid at a slower rate than a rate at which said tank is filled with fluid.

6. The water display as recited in claim 1, further comprising a pool that is located below said tank and collects the fluid that flows from said tube.

7. A water display, comprising:

a tank that has a floor and contains a fluid;

a plurality of tubes attached to said tank, each tube having an opening located a predetermined distance from said floor and a diameter that creates droplets of fluid;

a ballast located within said tank;

a piston that moves said ballast between a first position where the level of fluid is below said opening of said tube and a second position where said ballast displaces the fluid to a level above said opening of said tube, wherein the fluid flows out of said tank and through said tube;

a supply pipe coupled to said tank;

a source of fluid that supplies fluid to said supply pipe; and, a valve that allows fluid to flow from said supply pipe to said tank when said ballast is in said second position.

8. The water display as recited in claim 7, said supply pipe is filled with fluid at a slower rate than a rate at which said tank is filled with fluid.

9. The water display as recited in claim 8, further comprising a pool that is located below said tank and collects the fluid that flows from said tubes.

10. A water display, comprising:

a tank that has a floor and contains a fluid;

a tube attached to said tank, said tube having an opening located a predetermined distance from said floor;

a ballast located within said tank;

a control mechanism that moves said ballast between a first position where the level of fluid is below said opening of said tube and a second position where said ballast displaces the fluid to a level above said opening of said tube, wherein the fluid flows out of said tank and through said tube.

11. The water display as recited in claim 10, wherein said tube creates a plurality of fluid droplets.

12. The water display as recited in claim 10, further comprising a fluid supply that introduces fluid into said tank when said ballast is in said second position at a flowrate approximately equal to a flowrate of fluid through said tube.

13. The water display as recited in claim 12, wherein said fluid supply includes a supply pipe coupled to said tank and said control mechanism includes a pressure sensitive piston that is coupled to said supply pipe, said pressure sensitive piston moves said ballast to said second position when a fluid pressure within said supply pipe reaches a threshold level.

14. The water display as recited in claim 13, said supply pipe is filled with fluid at a slower rate than a rate at which said tank is filled with fluid.

15. The water display as recited in claim 10, further comprising a pool that is located below said tank and collects the fluid that flows from said tube.

* * * * *